US007757969B2

(12) United States Patent
Lacher et al.

(10) Patent No.: US 7,757,969 B2
(45) Date of Patent: Jul. 20, 2010

(54) JET REGULATOR

(75) Inventors: Wolf-Dieter Lacher, Mullheim (DE); Hermann Grether, Mullheim (DE)

(73) Assignee: Neoperl GmbH, Mullheim (DE)

( * ) Notice: Subject to any disclaimer, the term of this patent is extended or adjusted under 35 U.S.C. 154(b) by 182 days.

(21) Appl. No.: 11/813,637

(22) PCT Filed: Dec. 31, 2005

(86) PCT No.: PCT/EP2005/014167

§ 371 (c)(1),
(2), (4) Date: Jul. 10, 2007

(87) PCT Pub. No.: WO2006/074820

PCT Pub. Date: Jul. 20, 2006

(65) Prior Publication Data

US 2008/0169361 A1 Jul. 17, 2008

(30) Foreign Application Priority Data

Jan. 12, 2005 (DE) ..... 10 2005 001 419

(51) Int. Cl.

| | |
|---|---|
| ***E03C 1/084*** | (2006.01) |
| ***E03C 1/08*** | (2006.01) |
| ***B05B 7/06*** | (2006.01) |
| ***B05B 7/08*** | (2006.01) |
| ***B05B 1/26*** | (2006.01) |
| ***B05B 1/14*** | (2006.01) |

(52) U.S. Cl. ..... 239/428.5; 239/432; 239/500; 239/504; 239/520; 239/590.3; 239/590.5; 239/600

(58) Field of Classification Search ..... 239/418, 239/419, 419.5, 421, 428.5, 429, 432, 461, 239/462, 500, 504, 518, 520, 553, 553.3, 239/553.5, 590, 590.3, 590.5, 600
See application file for complete search history.

(56) References Cited

U.S. PATENT DOCUMENTS 2,633,343 A * 3/1953 Aghnides ..... 239/428.5

(Continued)

FOREIGN PATENT DOCUMENTS

DE 3000799 7/1981

(Continued)

*Primary Examiner*—Darren W Gorman
(74) *Attorney, Agent, or Firm*—Volpe and Koenig, P.C.

(57) ABSTRACT

A jet regulator (1) having a jet fractionating device (2) which distributes the incoming water flow into a plurality of individual jets is provided. The jet regulator (1) has at least one individual jet, from the individual jets formed by the fractionating device, which impacts on a node point (3) of a criss-crossing grid of bars (4, 5) of an outlet side downstream grid network (6). At least one node point (3) is configured as an inlet side recess of the grid network (6) and/or the jet regulator is an aerated jet regulator having a jet regulator housing (7) which includes at least one aeration opening (8) on a periphery of the housing thereof and at least one deflecting projection (9) which is used to maintain the water jet at a distance from the aeration opening that is arranged on the inner periphery of the housing in the direction of flow below the at least one aeration opening (8). The jet regulator (1) provides an improved fractionating of the incoming individual jets.

10 Claims, 6 Drawing Sheets

U.S. PATENT DOCUMENTS

| | | | |
|---|---|---|---|
| 4,313,564 | A | 2/1982 | Shames et al. |
| 4,537,360 | A | 8/1985 | Bock |
| 2006/0011748 | A1 | 1/2006 | Ferrari |

FOREIGN PATENT DOCUMENTS

| | | |
|---|---|---|
| DE | 20010099 | 9/2000 |
| DE | 10313501 | 10/2004 |
| WO | 2004033807 | 4/2004 |

* cited by examiner

JET REGULATOR

BACKGROUND

The invention relates to a jet regulator with a jet fractionating device, which distributes the incoming water flow into a plurality of individual jets.

From DE 30 00 799 a jet regulator is already known, which is provided with a jet fractionating device embodied as a perforated plate. This jet fractionating device of the previously known jet regulator distributes the incoming water flow into a plurality of individual jets. The individual jets formed in the jet fractionating device impinge several subsequent metal sieves of a flow rectifier downstream, which return the individual jets back into one uniform, bubbling combined jet.

From WO 2004/033807 A1 an aerated jet regulator with a jet fractionating device is already known, which distributes the incoming water flow into a multitude of individual jets. Here, the jet fractionating device is aligned such that the individual jets each impinge a nodal point of criss-cross grid bars of a grid network arranged downstream. In order to aerate the individual jets several aeration openings are provided at the housing perimeter of the jet regulator housing. The air necessary to aerate the water jet can be suctioned in through the aeration openings. However, this bears the risk that the air suction and thus the duly functioning of the previously known jet regulators are compromised by the passing swirled water jet.

From U.S. Pat. No. 4,313,564, a self-cleaning jet regulator is known, that in the jet regulator housing has a jet fractionating device, that distributes the incoming water flow into a plurality of individual jets. The jet fractionating device of this known jet regulator has a central cleaning opening, that is closed with the help of a valve body. This valve body is movable against the return force of a compression spring under pressure of the through flowing water from the open position to a closed position. While the jet fractionating device is able to carry out its function in the closed position of the valve body, in the open position of the valve body the particles of dirt carried in the water in the area of the jet fractionating device are able to pass through the central cleaning opening. The jet fractionating device is followed by a flow rectifier that takes the individual jets created by the jet fractionating device and recombines them to form a single uniform stream, and is formed by a plurality of stacked metal screens. The compression spring is supported on the metal screens of the flow rectifier, and contacts the valve body with its other end. The metal screens are held in place on the side opposite the valve body with the help of a split ring that is supported on the flow side against an annular ring. This annular ring allows the split ring to be fixed in position, which split ring holds the metal screen in position on the outflow side. The provided annular ring of U.S. Pat. No. 4,313,564 is therefore to a great extent located under the aeration openings.

SUMMARY

The objective is to provide a jet regulator of the type noted at the outset, that can be produced with relatively little expense, which is characterized in improved and/or further distributed incoming individual jets.

The solution of this object according to the invention is described in independent claim 1.

In the jet regulator according to the invention at least one of the individual jets formed in the jet fractionating device impinges a nodal point of individually crossing grid bars of a grid network arranged downstream. Due to the fact that at least some of the individual jets coming from the jet fractionating device impinge a nodal point formed by the criss-crossing grid bars another multi-axial jet fractionation of each individual jet occurs in this area.

When the nodal points each are embodied as recesses at the inflowing side of the preferably plate-shaped grid network, here another secondary fractionating of the individual jets occurs. Namely, the individual jets are not only distributed in the axial direction, rather an additional radial fractionating of the individual jets occurs at the axial walls limiting the recesses of the jet regulator according to the invention. This way, in this area a fractionating of the individual jets is further facilitated, with an undesired excessive swirling of the individual jets impinging the nodal points being avoided.

Additionally or alternatively the jet regulator may also be embodied as an aerated jet regulator with its jet regulator housing being provided at its exterior perimeter with at least one separate aerating opening in the circumferential direction and at the interior housing circumference, in the flow direction downstream of the aeration openings, is provided with at least one deflector portion to keep the eddied water jets away from the aeration openings, the deflector portions encircle the inner circumferential side of the outer rim of a separate construction part provided grid-work. Through the aeration openings provided on the housing perimeter of the jet regulator housing, the air necessary for aerating the water jet can be suctioned in through the aeration openings provided at the housing perimeter of the jet regulator housing. In order for this air intake not to interfere with the passing swirled water jet, deflector portions are provided at the interior housing circumference of the jet regulator according to the invention in the flow direction downstream of at least one aeration opening. The deflector portions keep the swirled water jet flowing through the interior of the housing of the jet regulator away from the aeration openings.

Here, it is advantageous for the grid network to be embodied plate-shaped.

It is advantageous for the grid bars, at the upstream side, to be at least rounded or chamfered in sections at the side of the longitudinal edge in the area of some of its nodal points. Due to the fact that in this embodiment the grid bars are rounded or chamfered at the upstream side at least in the area of the nodal points at both sides of the longitudinal edges, an excessive swirling of the individual jets is avoided and the formation of a uniform, bubbling water jet is improved.

Here, a preferred embodiment according to the invention provides for the grid bars to be chamfered at the upstream side like a gabled roof in an area of their nodal points.

A particularly advantageous embodiment of the invention provides for the recesses of the grid network at the upstream side to be embodied like hollow cylinders.

Here, the deflecting projection may be shaped like a flange and, in particular at its flat sides facing to and/or away from the water flow, be arranged in reference to each other in approximately parallel cross-sectional levels.

However it is particularly advantageous when the deflecting projection on the side facing away from the aeration opening in the flow direction, has an expanded angled deflection surface. By the angled deflection surface expanding in the flow direction, a water jet swirled in the interior of the housing is guided away from the aeration openings provided at the housing perimeter towards the longitudinal axis of the housing.

In order to modularly provide the jet regulator according to the invention it is advantageous that the grid network can be inserted into the housing as a separate part. Thus, the jet regulator can optionally be provided with or without the grid network embodied according to the invention.

For the modular design of the jet regulator according to the invention it is advantageous when the grid network is followed downstream by at least one additional part of a rectifying device and/or a flow rectifier that can be inserted into the housing.

BRIEF DESCRIPTION OF THE DRAWINGS

Further embodiments according to the invention are discernible from the claims as well as the drawing. In the following, the invention is explained in greater detail using an exemplary embodiment.

Shown are.

DETAILED DESCRIPTION OF THE PREFERRED EMBODIMENTS

Figure 1:
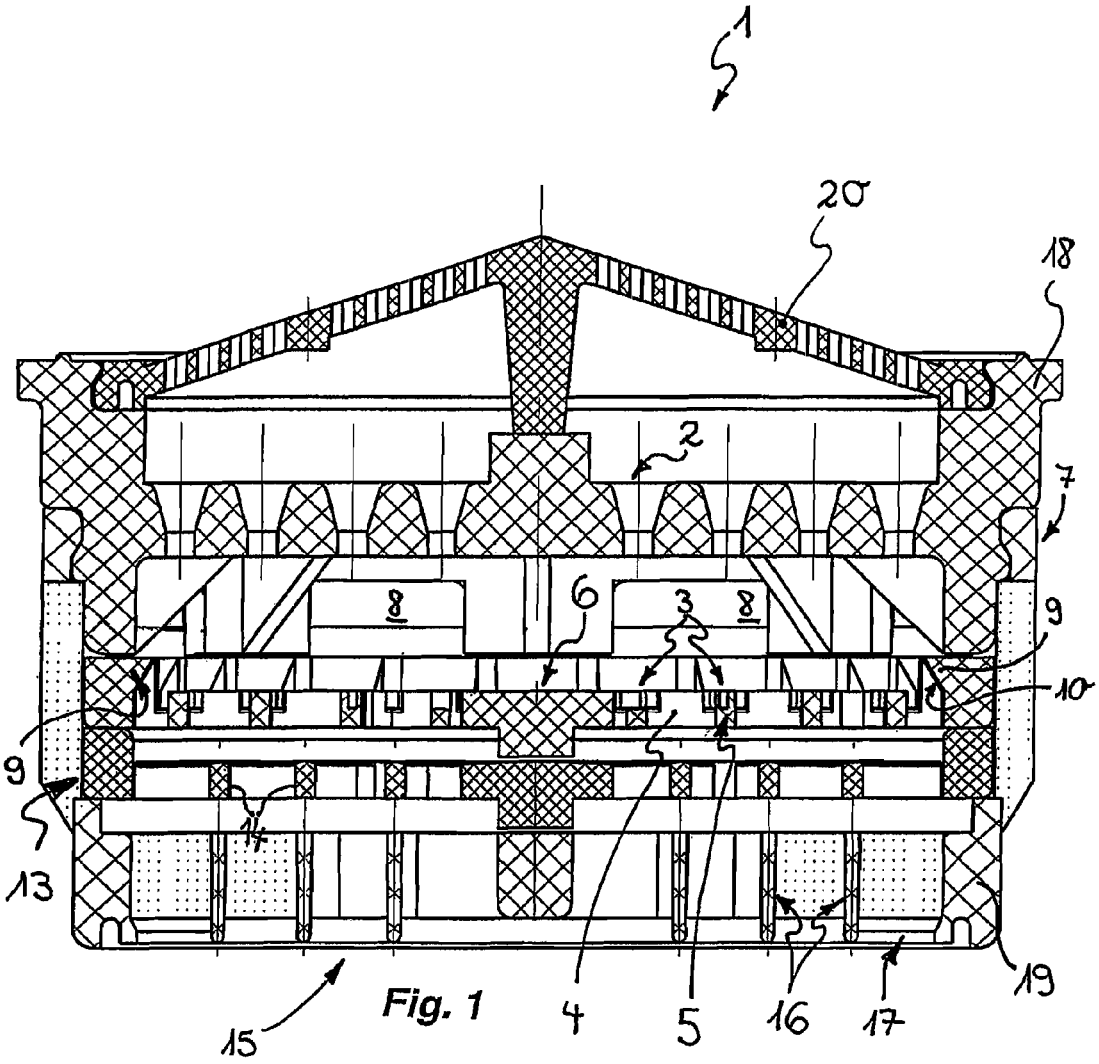
FIG. 1 a longitudinal cross-sectional view of a jet regulator having a jet fractionating device embodied as a perforated plate, which in the flow direction downstream is followed by a plate-shaped grid network with criss-crossing grid bars.
Figure 5:
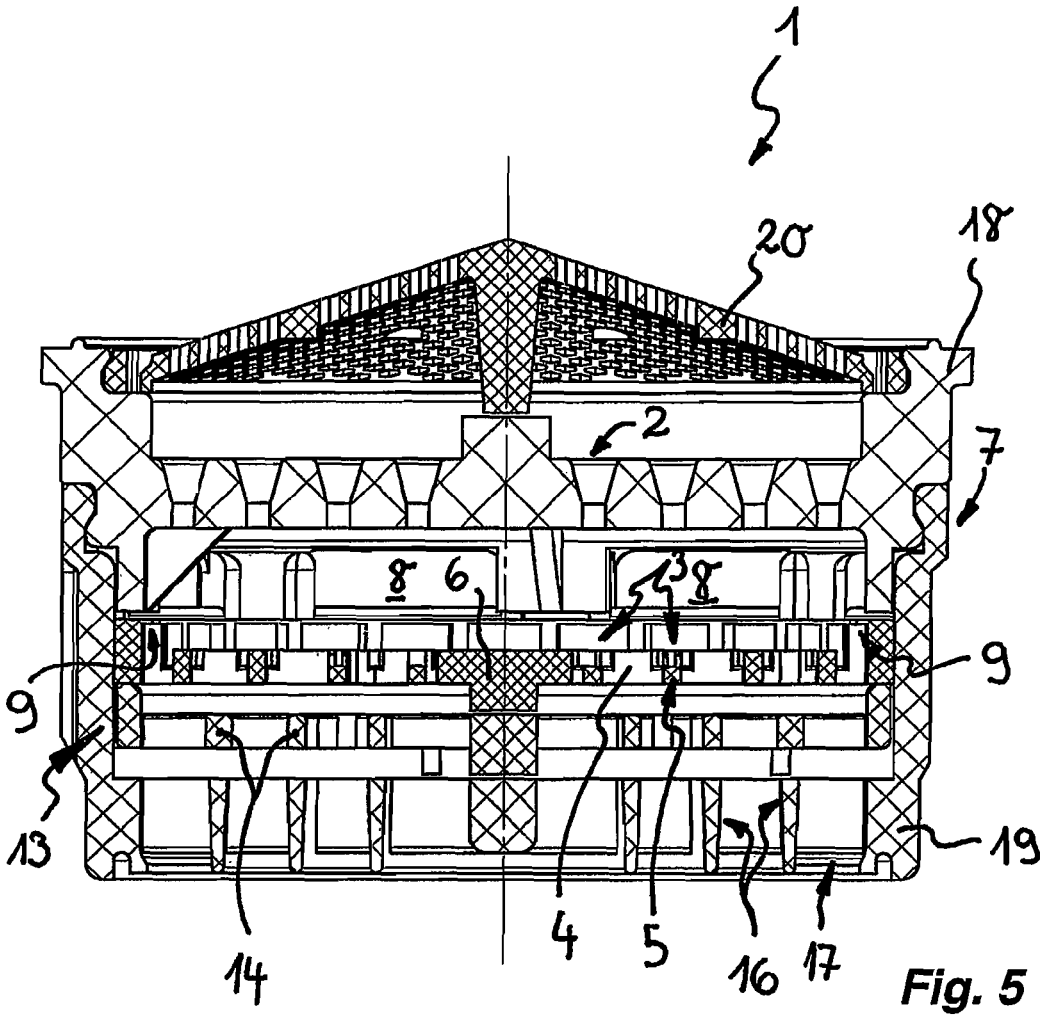

In both FIGS. 1 and 5 a jet regulator 1 is shown, which has a jet fractionating device comprised of a perforated plate 2, which distributes the incoming water jet into a multitude of individual jets. From FIGS. 1 and 5 it is discernible that the individual jets formed in the jet fractionating device 2 each impinge a nodal point 3 of criss-crossing grid bars 4, 5 of a grid network 6 arranged downstream. Here, the grid bars 4 are formed as radial bars and the grid bars 5 as concentric circular walls. In the area of the nodal points 3, another multi-axis fractionating of the individual incoming jets occurs.

Figure 2:
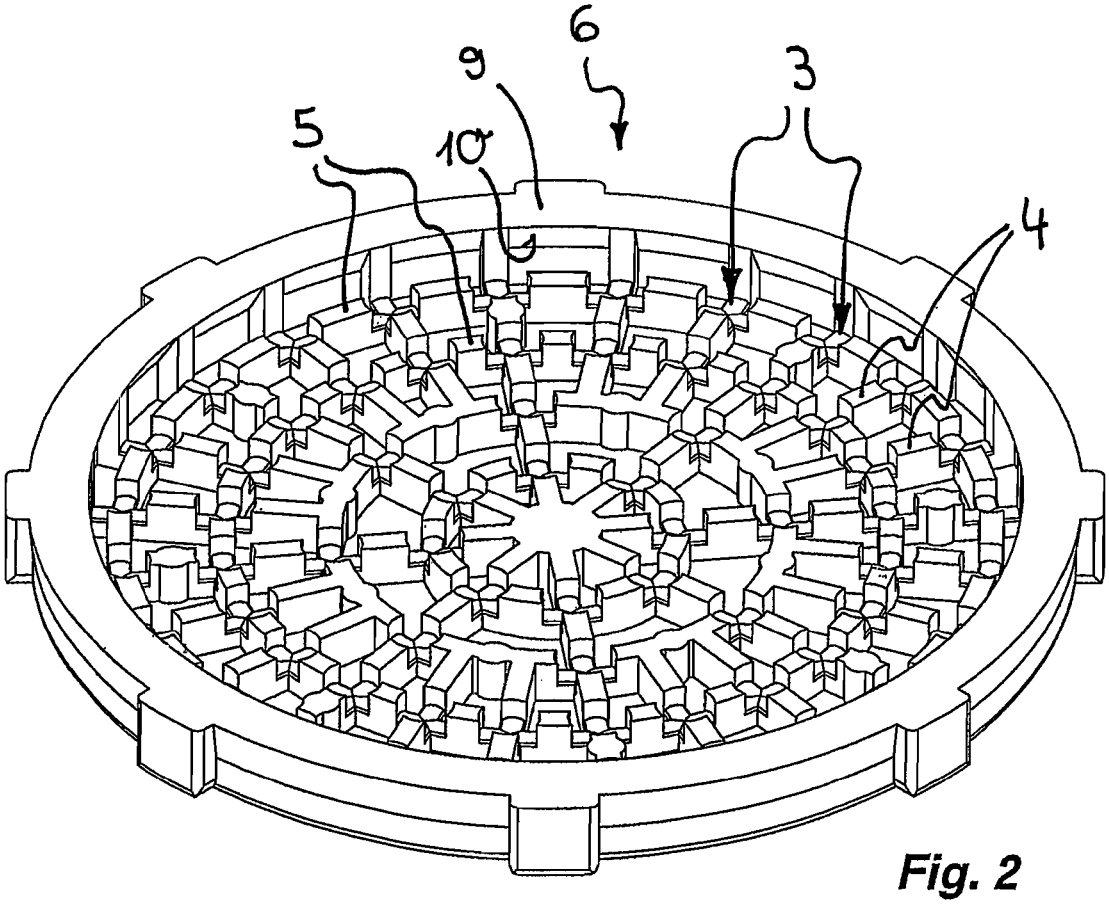
FIG. 2 a perspective view of the grid network of the jet regulator of FIG. 1, FIG. 3 a top view at the upstream side of the grid network of FIG. 2, FIG. 4 a longitudinal cross-sectional view of the grid network of FIGS. 2 and 3, FIG. 5 a longitudinal cross-sectional view of a jet regulator of similar function as in FIG. 1 and also aerated, which is provided, in the area of its aeration openings, with a flange-like circularly extending deflection projection, FIG. 6 a perspective view of the grid network of the jet regulator shown in FIG. 5, FIG. 7 a top view at the incoming side of the grid network of FIG. 6 in a top view, and FIG. 8 a longitudinal cross-sectional view of the grid network of FIGS. 6 and 7.
Figure 3:
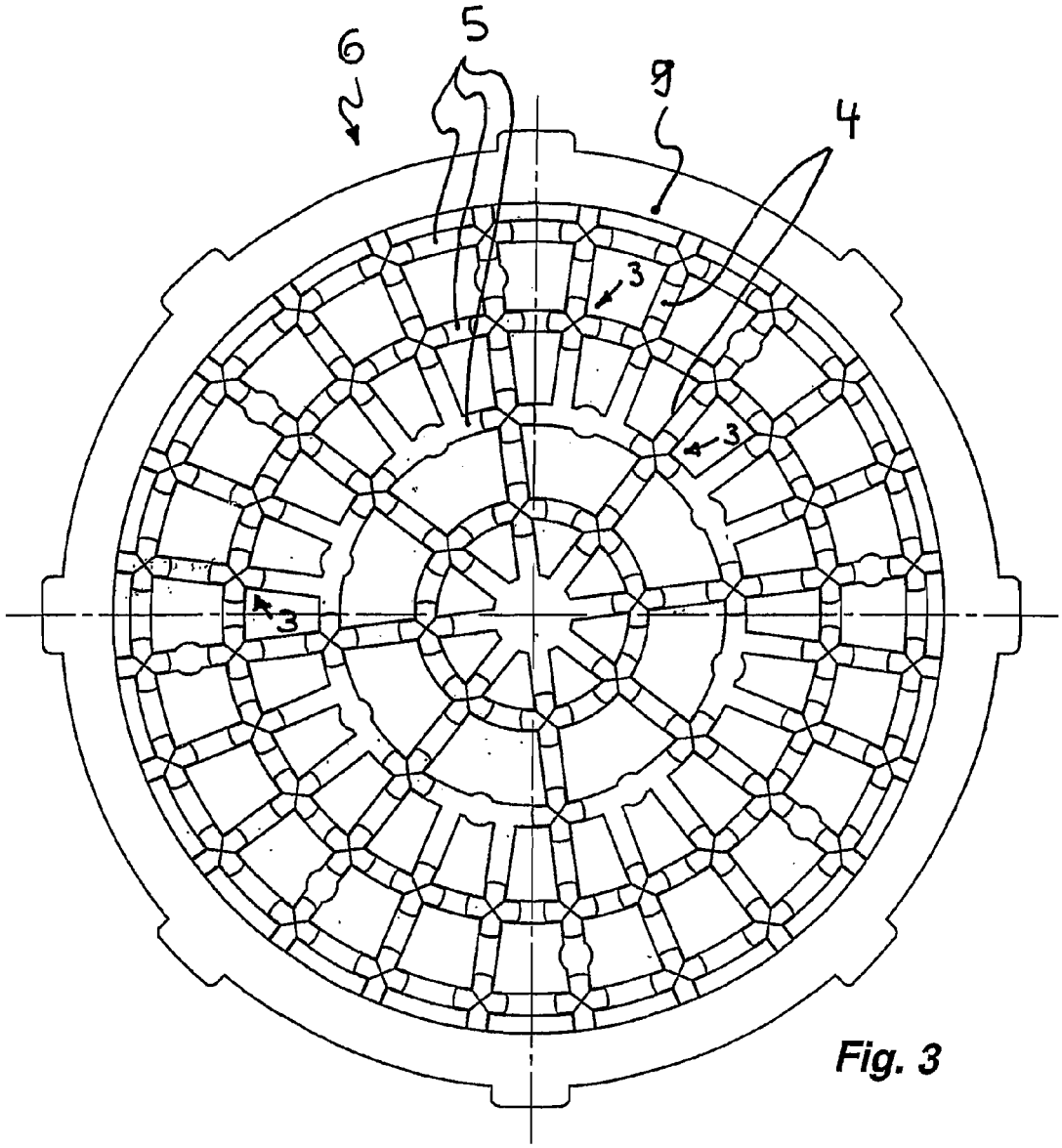
Figure 6:
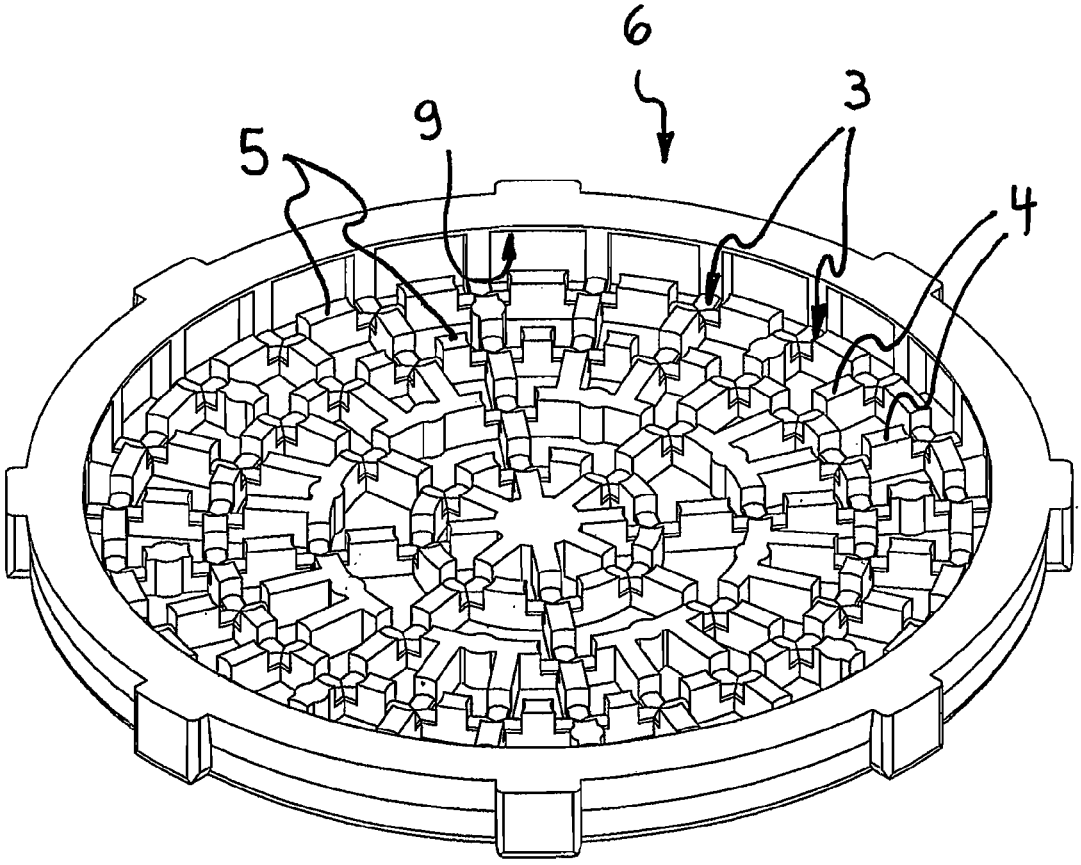
Figure 7:
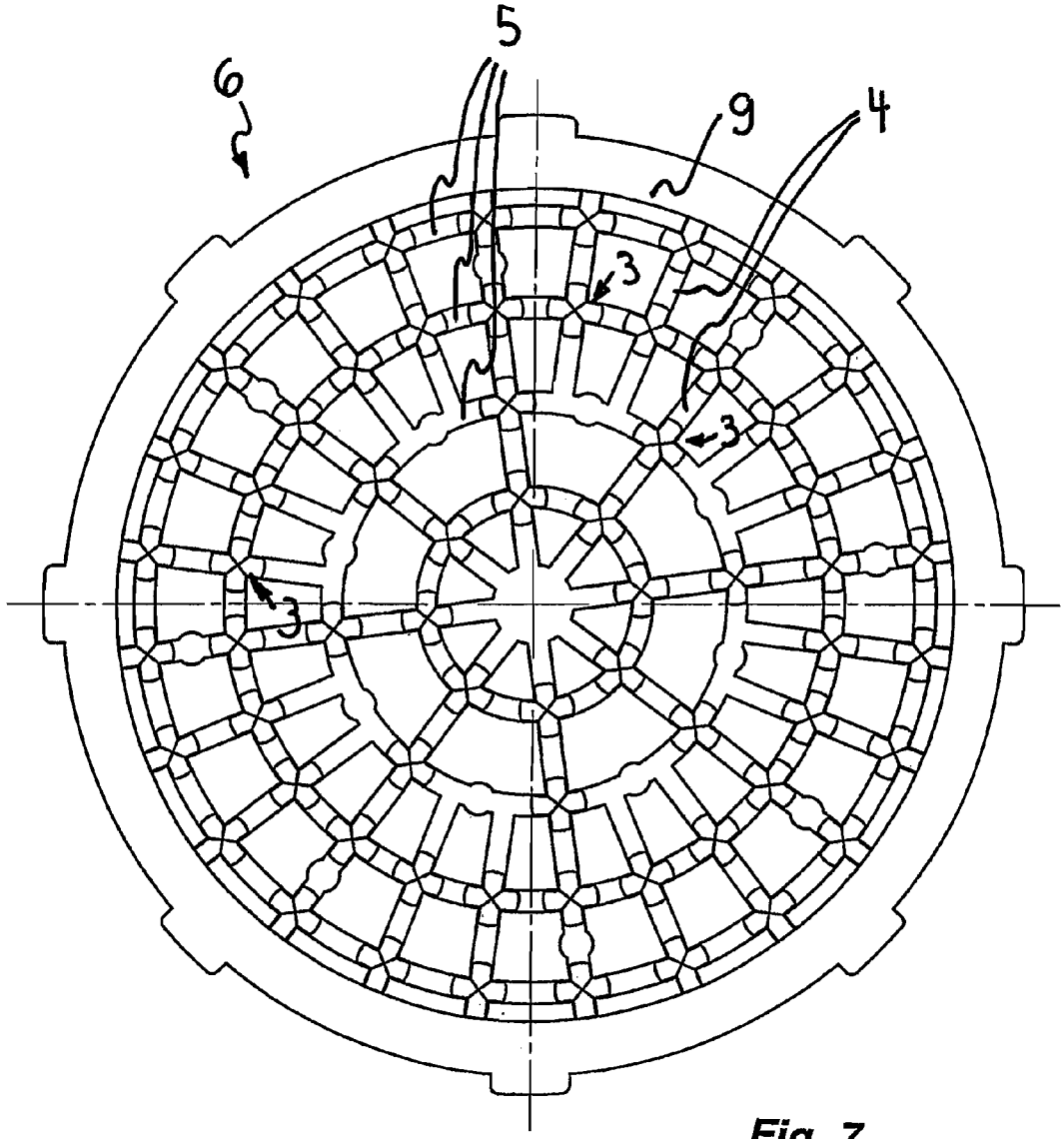

From a comparison of FIGS. 1 through 3 and/or FIGS. 5 through 7 it is discernible that the grid bars 4, 5 in the area of their nodal points 3 are chamfered at both sides of the longitudinal edges. In the exemplary embodiment shown here, the grid bars 4, 5 are chamfered in the area of their nodal points 3 at the incoming side in the form of a gabled roof. Due to the fact that grid bars 4, 5 are chamfered or rounded in this area, an excessive undesired swirling of the individual jets coming from the jet fractionating device 2 is avoided and the formation of a uniform, bubbling combined jet in the jet regulator 1 is facilitated.

In FIGS. 1 through 4 and FIGS. 5 through 8 it is shown that the nodal points 3 are each embodied as recesses of the preferably plate-shaped grid network 6 at the incoming side. Here, the recesses of the grid network 6 at the incoming side are formed as hollow cylinders. Due to the fact that the nodal points 3 are embodied as recesses of the plate-shaped grid network 6 these recesses are limited by the neighboring grid bars 4, 5. In the nodal points 3 embodied as recesses of the grid network 6, another secondary distribution of the individual jets inflowing from the perforated plate 2 occurs, because the water jet distributed in the nodal points along the gabled-roof lines at the end of the recess impinges the wall arranged approximately perpendicular in reference to the gable-roof line wall limiting the recess. In this manner, the jet is fractionated once more and slowed down. The jet regulator 1 shown here is therefore characterized in highly fractionated incoming individual jets with an undesired swirling of these individual jets in the interior of the housing of the jet regulator 1 being avoided.

From FIGS. 1 and 5 it is discernible that the jet regulator 1 shown here is an aerated jet regulator. The jet regulator 1 is provided with a jet regulator housing 7, which has several aeration openings 8 at its housing perimeter, evenly distanced from each other in the circumferential direction. With the help of the water flowing through the housing interior of the jet regulator 1, air can be suctioned into the interior of the housing, through the aerating openings 8, which is then used to aerate the water jet.

Figure 4:
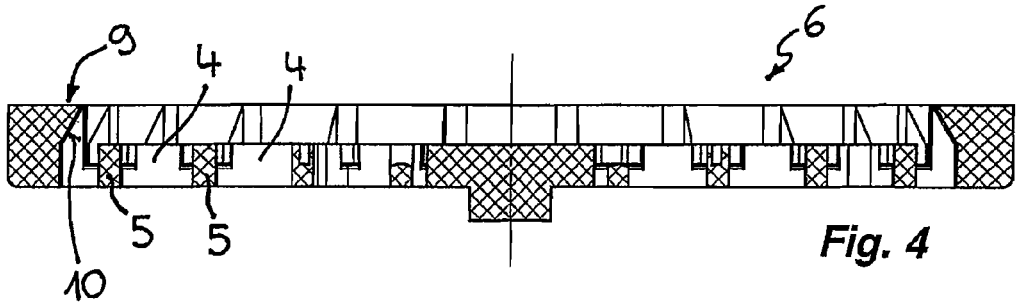
Figure 8:
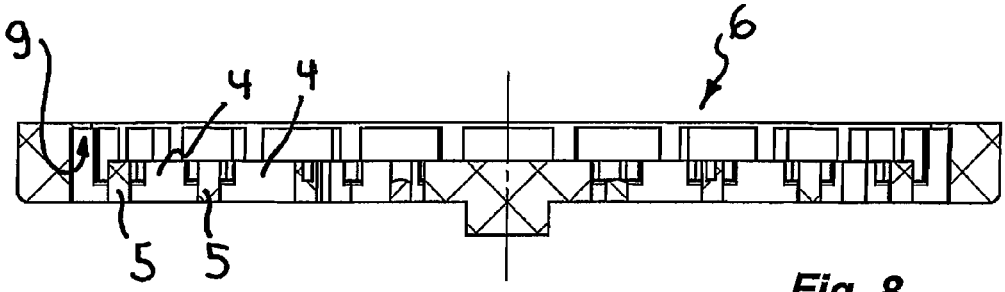

Comparing FIGS. 1 and 4 and/or FIGS. 5 and 8 it becomes clear that at the interior circumference of the housing, in the flow direction downstream in reference to the aeration openings 8, a deflecting projection 9 is provided. This deflecting projection 9 encircles the grid network 6 in a circular fashion. In FIGS. 1 and 4 it is discernible that the circular deflecting projection 9 at its side facing away from the aeration openings 8 in the flow direction is provided with an angled deflection surface 10, which is expanded in the flow direction. However, the deflecting projection 9, here also encircling in a circular fashion, is embodied as a flange in the jet regulator 1 shown in FIGS. 5 through 8, with its flange sides facing towards and/or away from the water flow being arranged in approximately parallel cross-sectional levels in reference to each other. By the deflecting projection 9, the water jet to be aerated can be kept at a distance from the aeration openings 8 that open in the interior of the housing. Here, the swirled water jets are guided away from the aeration openings 8 in the direction of the longitudinal axis of the jet regulator housing 7 with the help of the deflecting projection 9 and particularly with the angled deflection surface 10.

When comparing FIGS. 1 through 4 as well as FIGS. 5 through 8 it is discernible that the grid network 6 is provided as a separate plate-shaped part. The grid network 6 provided as a separate part can be inserted into the jet regulator housing 7 in a detachable manner. Here, the grid network 6 is followed by another part 13 of the rectifying device that can be inserted into the housing 7. The part 13, also formed in a plate-shaped manner, is provided with several circular walls 14, each of which are arranged in the extension between two nodal points 3 of the grid network 6.

The part 13 is a downstream flow rectifier 15, which forms the face of the jet regulator 1 at the outflow side. The flow rectifier 15 of the jet regulator 1, shown in FIGS. 1 through 4 and/or FIGS. 5 through 8, is also provided with circular walls 16, which are arranged in the extension of the circular walls 16 of the part 13 and therefore have a slightly smaller wall thickness in reference thereto. The circular walls 16 of the flow rectifier 15 are rounded at their down-stream narrow edge in order to promote the formation of a overall uniform jet. For the same purpose a circularly extending housing constriction 17 is provided in the flow rectifier 15 at the outflow side of the housing edge.

From FIG. 1 it is discernible that the jet regulator housing 7 of the jet regulator 1 is essentially provided in two parts. The jet regulator housing 7, divided into a separating level aligned perpendicularly in reference to the flow direction, is provided with a housing part 18, 19 at the inflow and the outflow sides, which can engage each other in a detachable manner, but which also may be connected to each other additionally by sealing, welding or the like.

In FIGS. 1 and 5 it is shown that the jet regulators 1, at the incoming side, are essentially provided upstream with a cone-shaped presieve, which separates the dirt particles entrained and keeps them from the jet regulators 1. At the inflowing side of the jet regulator housing 7 the presieve 20 can be snapped to the face of the housing in a detachable manner.

The invention claimed is:

1. A jet regulator (1) comprising a jet fractionating device (2) for dispersing an incoming water flow into a multitude of individual jets, of which at least one of the individual jets impinges at least one nodal point (3) of criss-crossing grid bars (4, 5), having a downstream surface located in and defining a single plane, of a grid network (6) arranged downstream from the jet fractionating device that is provided as a separate construction part in a jet regulator housing of the jet regulator, with the at least one nodal point (3) comprising a recess of the grid network (6) at an incoming side thereof located above the single plane, and the jet regulator (1) being an aerated jet regulator (1) with the jet regulator housing (7) being provided at a housing perimeter with a plurality of circumferentially separated aeration openings (8) and at an interior housing circumference in a flow direction below the aeration openings, a deflection projection is located to keep the water jets away from the aeration openings (8), the deflection projection extending inwardly encircling an inner circumference of an outer wall of the separately constructed grid network (6).

2. A jet regulator according to claim 1, wherein the grid network is plate-shaped.

3. A jet regulator according to claim 1, wherein the at least one nodal point comprises nodal points and the grid bars (4, 5) at the incoming side are rounded or chamfered at least in an area of some of the nodal points (3) and/or at a longitudinal side.

4. A jet regulator according to claim 3, wherein the nodal points comprise recesses of the grid network (6) having a form of hollow cylinders at the incoming side.

5. A jet regulator according to claim 1, wherein the deflection projection is provided with an extended angled deflection surface (10) at a side thereof in a flow direction facing away from the aeration openings.

6. A jet regulator according to claim 1, wherein the grid network (6) is at least followed downstream by one additional part (13) that can be inserted into the housing (7) comprising a homogenization device and/or a flow rectifier.

7. A jet regulator (1) comprising a jet fractionating device (2) for dispersing an incoming water flow into a multitude of individual jets, of which at least one of the individual jets impinges at least one nodal point (3) of criss-crossing grid bars (4, 5), that are chamfered in the form of gabled roofs at an incoming side, of a downstream arranged grid network (6) that is provided as a separate construction part in a jet regulator housing of the jet regulator, with the at least one nodal point (3) comprising a recess of the grid network (6) at an incoming side thereof.

8. A jet regulator (1) comprising a jet fractionating device (2) for dispersing an incoming water flow into a multitude of individual jets, of which at least one of the individual jets impinges at least one nodal point (3) of criss-crossing grid bars (4, 5), which are chamfered in the form of gabled roofs at least in an area of some of the nodal points (3) and/or at a longitudinal side of a downstream arranged grid network (6) that is provided as a separate construction part in a jet regulator housing of the jet regulator, with the at least one nodal point (3) comprising a recess of the grid network (6) at an incoming side thereof, and the jet regulator (1) being an aerated jet regulator (1) with the jet regulator housing (7) being provided at a housing perimeter with a plurality of circumferentially separated aeration openings (8) and at an interior housing circumference in a flow direction below the aeration openings, a deflection projection is located to keep the water jets away from the aeration openings (8), the deflection projection extending inwardly encircling an inner circumference of an outer wall of the separately constructed grid network (6).

9. A jet regulator (1) comprising a jet fractionating device (2) for dispersing an incoming water flow into a multitude of individual jets, of which at least one of the individual jets impinges at least one nodal point (3) of criss-crossing grid bars (4, 5), having downstream surfaces located in and defining a single plane, of a grid network (6) arranged downstream from the jet fractionating device that is provided as a separate construction part in a jet regulator housing of the jet regulator, wherein the jet regulator (1) is an aerated jet regulator (1) with the jet regulator housing (7) being provided at a housing perimeter with a plurality of circumferentially separated aeration openings (8) and at an interior housing circumference in a flow direction below the aeration openings, the grid network including a deflection projection located to keep the water jets away from the aeration openings (8), the deflection projection extending inwardly encircling an inner circumference of an outer wall of the separately constructed grid network (6).

10. A jet regulator (1) comprising a jet fractionating device (2) for dispersing an incoming water flow into a multitude of individual jets, of which at least one of the individual jets impinges at least one nodal point (3) of criss-crossing grid bars (4, 5), having downstream surfaces located in and defining a single plane, of a grid network (6) arranged downstream from the jet fractionating device that is provided as a separate construction part in a jet regulator housing of the jet regulator, wherein the at least one nodal point (3) comprises a recess of the grid network (6) at an incoming side thereof located above the single plane.

* * * * *